US010043533B2

(12) United States Patent
Daniel

(10) Patent No.: US 10,043,533 B2
(45) Date of Patent: Aug. 7, 2018

(54) METHOD AND DEVICE FOR BOOSTING FORMANTS FROM SPEECH AND NOISE SPECTRAL ESTIMATION

(71) Applicant: NXP B.V., Eindhoven (NL)

(72) Inventor: Adrien Daniel, Antibes (FR)

(73) Assignee: NXP B.V., Eindhoven (NL)

( * ) Notice: Subject to any disclaimer, the term of this patent is extended or adjusted under 35 U.S.C. 154(b) by 0 days.

(21) Appl. No.: 15/180,202

(22) Filed: Jun. 13, 2016

(65) Prior Publication Data

US 2016/0372133 A1 Dec. 22, 2016

(30) Foreign Application Priority Data

Jun. 17, 2015 (EP) ..... 15290161

(51) Int. Cl.

| | |
|---|---|
| ***G10L 25/15*** | (2013.01) |
| ***G10L 21/02*** | (2013.01) |
| ***G10L 21/0364*** | (2013.01) |
| ***G10L 21/0264*** | (2013.01) |
| ***G10L 19/06*** | (2013.01) |
| *G10L 19/00* | (2013.01) |

(52) U.S. Cl.

CPC ..... *G10L 21/0264* (2013.01); *G10L 19/06* (2013.01); *G10L 21/0205* (2013.01); *G10L 25/15* (2013.01); *G10L 2019/0016* (2013.01)

(58) Field of Classification Search

CPC . G10L 21/02; G10L 21/0208; G10L 21/0232; G10L 21/0316; G10L 21/0364; G10L 25/15

USPC ..... 704/209, 225, 226, 227, 228, 233; 381/94.2, 94.3, 94.7, 94.8

See application file for complete search history.

(56) References Cited

U.S. PATENT DOCUMENTS 5,459,813 A * 10/1995 Klayman ..... G10L 21/0364 381/82
5,742,927 A * 4/1998 Crozier ..... G10L 21/0208 704/209
5,953,696 A * 9/1999 Nishiguchi ..... G10L 21/0364 704/209

(Continued)

FOREIGN PATENT DOCUMENTS

JP 2004289614 A 10/2004
WO WO-1999001863 A1 1/1999

OTHER PUBLICATIONS

Extended European Search Report for Patent Appln. No. 15290161.7 (dated Dec. 14, 2015).

(Continued)

*Primary Examiner* — Martin Lerner

(57) ABSTRACT

A device including a processor and a memory is disclosed. The memory includes a noise spectral estimator to calculate noise spectral estimates from a sampled environmental noise, a speech spectral estimator to calculate speech spectral estimates from the input speech, a formant signal to noise ratio (SNR) estimator to calculate SNR estimates using the noise spectral estimates and speech spectral estimates within each formant detected in a speech spectrum. The memory also includes a formant boost estimator to calculate and apply a set of gain factors to each frequency component of the input speech such that the resulting SNR within each formant reaches a pre-selected target value.

18 Claims, 5 Drawing Sheets

(56) References Cited

U.S. PATENT DOCUMENTS 6,629,068 B1* 9/2003 Horos ..... G10L 19/26 704/205
2003/0198357 A1 10/2003 Schneider et al.
2009/0281800 A1 11/2009 LeBlanc et al.
2010/0226515 A1* 9/2010 Fischer ..... G10L 21/0208 381/317
2012/0265534 A1* 10/2012 Coorman ..... G10L 13/033 704/265
2012/0323571 A1* 12/2012 Song ..... G10L 21/0208 704/225
2013/0030800 A1* 1/2013 Tracey ..... G10L 21/003 704/219
2013/0073284 A1* 3/2013 Paranjpe ..... G10L 21/0208 704/226
2015/0142425 A1* 5/2015 Sjoberg ..... G10L 21/0364 704/226
2015/0215700 A1* 7/2015 Sun ..... G10L 21/0232 381/94.2
2015/0248893 A1* 9/2015 Kleijn ..... G10L 19/02 381/98
2015/0325250 A1* 11/2015 Woods ..... G10L 21/0208 704/205
2016/0035370 A1* 2/2016 Krini ..... G10L 21/02 704/209

OTHER PUBLICATIONS

Schepker, Henning et al; "Improving speech intelligibility in noise by SII-dependent preprocessing using frequency-dependent amplification and dynamic range compression"; Interspeech 2013, Lyon, FR; pp. 3577-3581 (Aug. 25-29, 2013).

Taal, Cees H. et al; "On Optimal Linear Filtering of Speech for Near-End Listening Enhancement"; IEEE Signal Processing Letters, vol. 20, No. 3; pp. 225-228 (Mar. 2013).

Tang, Yan et al; "Energy reallocation strategies for speech enhancement in known noise conditions"; Interspeech 2010, pp. 1636-1639 (2010).

Zorila, Tudor-Catalin et al; "Speech-in-noise intelligibility improvement based on spectral shaping and dynamic range compression"; Interspeech 2012, vol. 8; 4 pages (2012).

* cited by examiner

METHOD AND DEVICE FOR BOOSTING FORMANTS FROM SPEECH AND NOISE SPECTRAL ESTIMATION

CROSS-REFERENCE TO RELATED APPLICATIONS

This application claims the priority under 35 U.S.C. § 119 of European patent application no. 15290161.7, filed Jun. 17, 2015 the contents of which are incorporated by reference herein.

BACKGROUND

In mobile devices, noise reduction technologies greatly improve the audio quality. To improve the speech intelligibility in noisy environments, the Active Noise Cancellation (ANC) is an attractive proposition for headsets and the ANC does improve audio reproduction in noisy environment to certain extents. The ANC method has less or no benefits, however, when the mobile phone is being used without ANC headsets. Moreover the ANC method is limited in the frequencies that can be cancelled.

However, in noisy environments, it is difficult to cancel all noise components. The ANC methods do not operate on the speech signal in order to make the speech signal more intelligible in the presence of noise.

Speech intelligibility may be improved by boosting formants. A formant boost may be obtained by increasing the resonances matching formants using an appropriate representation. Resonances can then be obtained in a parametric form out of the linear predictive coding (LPC) coefficients. However, it implies the use of polynomial root-finding algorithms, which are computationally expensive. To reduce computational complexity, these resonances may be manipulated through the line spectral pair representation (LSP). Strengthening resonances consists in moving the poles of the autoregressive transfer function closer to the unit circle. Still this solution suffers from an interaction problem, where resonances which are close to each other are difficult to manipulate separately because they interact. It thus requires an iterative method which can be computationally expensive. But even if proceeded with care, strengthening resonances narrows their bandwidth, which results in an artificially-sounding speech.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Embodiments described herein address the problem of improving the intelligibility of a speech signal to be reproduced in the presence of a separate source of noise. For instance, a user located in a noisy environment is listening to an interlocutor over the phone. In such situations where it is not possible to operate on noise, the speech signal can be improved to make it more intelligible in the presence of noise.

A device including a processor and a memory is disclosed. The memory includes a noise spectral estimator to calculate noise spectral estimates from a sampled environmental noise, a speech spectral estimator to calculate speech spectral estimates from the input speech, a formant signal to noise ratio (SNR) estimator to calculate SNR estimates using the noise spectral estimates and speech spectral estimates within each formant detected in the input speech, and a formant boost estimator to calculate and apply a set of gain factors to each frequency component of the input speech such that the resulting SNR within each formant reaches a pre-selected target value.

In some embodiments, the noise spectral estimator is configured to calculate noise spectral estimates through averaging, using a smoothing parameter and past spectral magnitude values obtained through a Discrete Fourier Transform of a sampled environmental noise. In one example, the speech spectral estimator is configured to calculate the speech spectral estimates using a low order linear prediction filter. The low order linear prediction filter may use Levinson-Durbin algorithm.

In one example, the formant SNR estimator is configured to calculate the formant SNR estimates using a ratio of speech and noise sums of squared spectral magnitudes estimates over a critical band centered on a formant center frequency. The critical band is a frequency bandwidth of an auditory filter.

In some examples, the set of gain factors is calculated by multiplying each formant segment in the input speech by a pre-selected factor.

In one embodiment, the device may also include an output limiting mixer to limit an output of a filter that is created by the formant boost estimator, to a pre-selected maximum root mean square level or peak level. The formant boost estimator produces a filter to filter the input speech and an output of the filter combined with the input speech is passed through the output limiting mixer. Each formant in the speech input is detected by a formant segmentation module, wherein the formant segmentation module segments the speech spectral estimates into formants.

In another embodiment, a method for performing an operation of improving speech intelligibility, is disclosed. Furthermore, a corresponding computer program product is disclosed. The operation includes receiving an input speech signal, receiving a sampled environmental noise, calculating noise spectral estimates from the sampled environmental noise, calculating speech spectral estimates from the input speech, calculating formant signal to noise ratio (SNR) from these estimates, segmenting formants in the speech spectral estimates and calculating formant boost factor for each of the formants based on the calculated formant boost estimates.

In some examples, the calculating of the noise spectral estimates includes through averaging, using a smoothing parameter and past spectral magnitude values obtained through a Discrete Fourier Transform of the sampled environmental noise. The calculating of the noise spectral estimates may also include using a low order linear prediction filter. The low order linear prediction filter may use Levinson-Durbin algorithm.

BRIEF DESCRIPTION OF THE DRAWINGS

So that the manner in which the above recited features of the present invention can be understood in detail, a more particular description of the invention, briefly summarized above, may be added by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments. Advantages of the subject matter claimed will become apparent to those skilled in the art upon reading this description in conjunction with the accompanying drawings, in which like reference numerals have been used to designate like elements, and in which:

DETAILED DESCRIPTION

When a user receives a mobile phone call or listens to a sound output from an electronic device in a noisy place, the speech becomes unintelligible. Various embodiments of the present disclosure improve the user experience by enhancing speech intelligibility and reproduction quality. The embodiments described herein may be employed in mobile device and other electronic devices that involve reproduction of speech, such as GPS receivers that includes voice directions, radio, audio books, podcast, etc.

The vocal tract creates resonances at specific frequencies in the speech signal—spectral peaks called formants—that are used by the auditory system to discriminate between vowels. An important factor in intelligibility is then the spectral contrast: the difference of energy between spectral peaks and valleys. The embodiments described herein improve intelligibility of the input speech signal in noise while maintaining its naturalness. The methods described herein apply to voiced segments only. The main reasoning behind it is that solely spectral peaks should target a certain level of unmasking, not spectral valleys. A valley might get boosted because unmasking gains are applied to its surrounding peaks, but the methods should not try to specifically unmask valleys (otherwise the formant structure may be destroyed). Besides, regardless of noise, the approach described herein increases the spectral contrast, which has been shown to improve intelligibility. The embodiments described herein may be used in static mode without any dependence on noise sampling, to enhance the spectral contrast according to a predefined boosting strategy. Alternatively, noise sampling may be used for improving speech intelligibility.

One or more embodiments described herein provide a low-complexity, distortion-free solution that allows spectral unmasking of voiced speech segments reproduced in noise. These embodiments are suitable for real-time applications, such as phone conversations.

To unmask speech reproduced in noisy environment with respect to noise characteristics, either time or frequency-domain methods can be used. Time-domain methods suffer from a poor adaptation to the spectral characteristics of noise. Spectral-domain methods rely on a frequency-domain representation of both speech and noise allowing to amplify frequency components independently, thereby targeting a specific spectral signal-to-noise ratio (SNR). However, common difficulties are the risk of distorting the speech spectral structure—i.e., speech formants and the computational complexity involved in getting a speech representation that allows operating such modifications with care.

Figure 1:
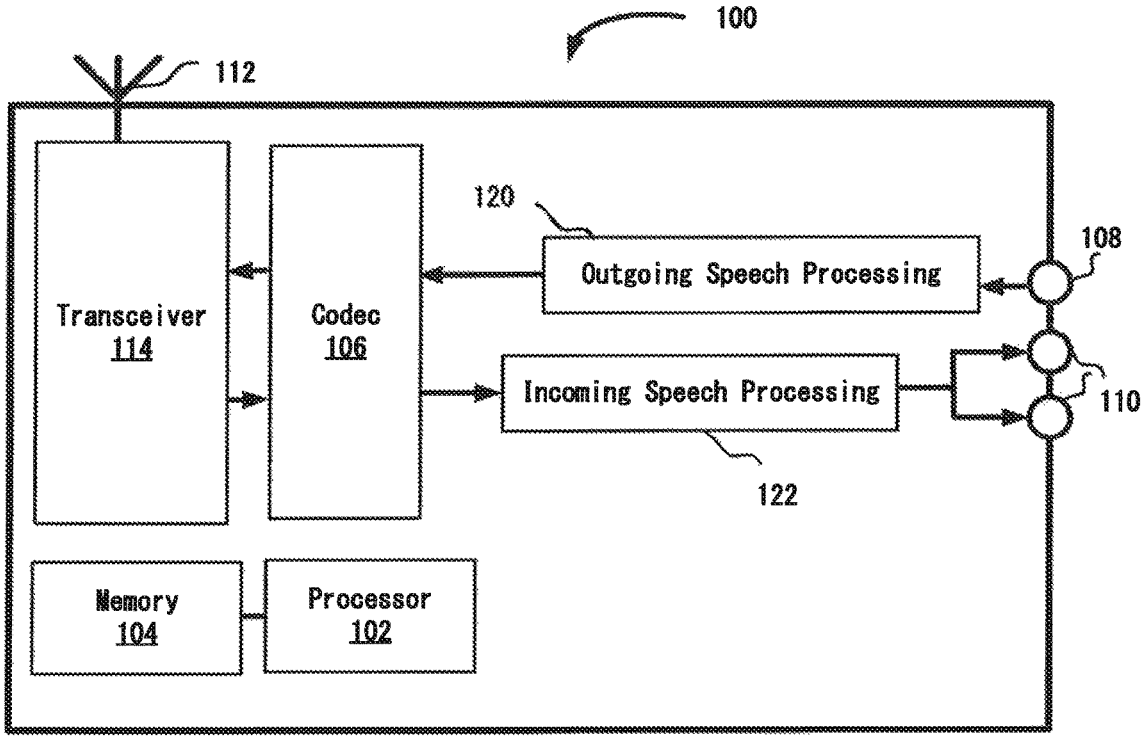
FIG. 1 is schematic of a portion of a device in accordance with one or more embodiments of the present disclosure.

FIG. 1 is schematic of a wireless communication device 100. As noted above, the applications of the embodiments described herein are not limited to wireless communication devices. Any device that reproduces speech may benefit from improved speech intelligibility that would result from one or more embodiments described herein. The wireless communication device 100 is being used merely as an example. So as not to Obscure the embodiments described herein, many components of the wireless communication device 100 are not being shown. The wireless communication device 100 may be a mobile phone or any mobile device that is capable of establishing an audio/video communication link with another communication device. The wireless communication device 100 includes a processor 102, a memory 104, a transceiver 114, and an antenna 112. Note that the antenna 112, as shown, is merely an illustration. The antenna 112 may be an internal antenna or an external antenna and may be shaped differently than shown. Furthermore, in some embodiments, there may be a plurality of antennas. The transceiver 114 includes a transmitter and a receiver in a single semiconductor chip. In some embodiments, the transmitter and the receiver may be implemented separately from each other. The processor 102 includes suitable logic and programming instructions (may be stored in the memory 104 and/or in an internal memory of the processor 102) to process communication signals and control at least some processing modules of the wireless communication device 100. The processor 102 is configured to read/write and manipulate the contents of the memory 104. The wireless communication device 100 also includes one or more microphone 108 and speaker(s) and/or loudspeaker(s) 110. In some embodiments, the microphone 108 and the loudspeaker 110 may be external components coupled to the wireless communication device 100 via standard interface technologies such as Bluetooth.

The wireless communication device 100 also includes a codec 106. The codec 106 includes an audio decoder and an audio coder. The audio decoder decodes the signals received from the receiver of the transceiver 114 and the audio coder codes audio signals for transmission by the transmitter of the transceiver 114. On uplink, the audio signals received from the microphone 108 are processed for audio enhancement by an outgoing speech processing module 120. On the downlink, the decoded audio signals received from the codec 106 are processed for audio enhancement by an incoming speech processing module 122. In some embodiments, the codec 106 may be a software implemented codec and may reside in the memory 104 and executed by the processor 102. The codec 106 may include suitable logic to process audio signals. The codec 106 may be configured to process digital signals at different sampling rates that are typically used in mobile telephony. The incoming speech processing module 122, at least a part of which may reside in a memory 104, is configured to enhance speech using boost patterns as described in the following paragraphs. In some embodiments, the audio enhancing process in the downlink may also use other processing modules as described in the following sections of this document.

In one embodiment, the outgoing speech processing module 120 uses noise reduction, echo cancelling and automatic gain control to enhance the uplink speech. In some embodiments, noise estimates (as described below) can be obtained with the help of noise reduction and echo cancelling algorithms.

Figure 2:
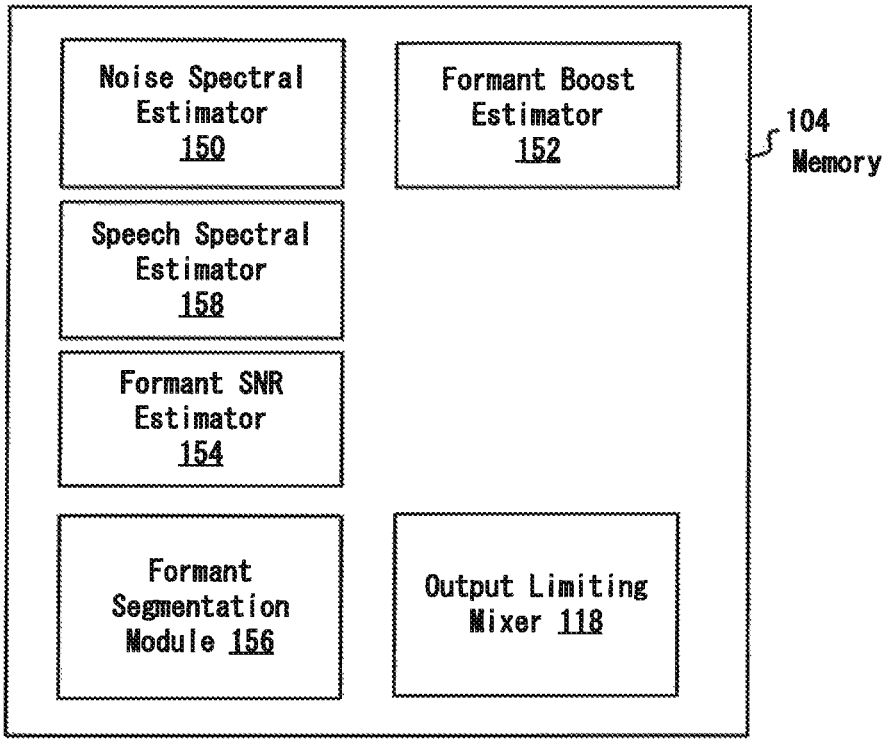
FIG. 2 is logical depiction of a portion of a memory of the device in accordance with one or more embodiments of the present disclosure.

FIG. 2 is logical depiction of a portion of the memory 104 of the wireless communication device 100. It should be noted that at least some of the processing modules depicted in FIG. 2 may also be implemented in hardware. In one embodiment, the memory 104 includes programming instructions which when executed by the processor 102 create a noise spectral estimator 150 to perform noise spectrum estimation, a speech spectral estimator 158 for calculating speech spectral estimates, a formant signal-to-noise ratio (SNR) estimator 154 for creating SNR estimates, a formant segmentation module 156 for segmenting speech spectral estimate into formants (vocal tract resonances), a formant boost estimator 152 to create a set of gain factors to apply to each frequency component of the input speech, an output limiting mixer 118 for finding a time-varying mixing factor applied to the difference between the input and output signals.

Noise spectral density is the noise power per unit of bandwidth; that is, it is the power spectral density of the noise. The Noise Spectral Estimator 150 yields noise spectral estimates through averaging, using a smoothing parameter and past spectral magnitude values (obtained for instance using a Discrete Fourier Transform of the sampled environmental noise). The smoothing parameter can be time-varying frequency-dependent. In one example, in a phone call scenario, near-end speech should not be part of the noise estimate, and thus the smoothing parameter is adjusted by near-end speech presence probability.

The Speech Spectral Estimator 158 yields speech spectral estimates by means of a low-order linear prediction filter (i.e., an autoregressive model). In some embodiments, such a filter can be computed using the Levinson-Durbin algorithm. The spectral estimate is then obtained by computing the frequency response of this autoregressive filter. The Levinson-Durbin algorithm uses the autocorrelation method to estimate the linear prediction parameters for a segment of speech. Linear prediction coding, also known as linear prediction analysis (LPA), is used to represent the shape of the spectrum of a segment of speech with relatively few parameters.

The Formant SNR Estimator 154 yields SNR estimates within each formant detected in the speech spectrum. To do so, the Formant SNR Estimator 154 uses speech and noise spectral estimates from the Noise Spectral Estimator 150 and the Speech Spectral Estimator 158. In one embodiment, the SNR associated to each formant is computed as the ratio of speech and noise sums of squared spectral magnitudes estimates over the critical band centered on the formant center frequency.

In audiology and psychoacoustics the term "critical band", refers to the frequency bandwidth of the "auditory filter" created by the cochlea, the sense organ of hearing within the inner ear. Roughly, the critical band is the band of audio frequencies within which a second tone will interfere with the perception of a first tone by auditory masking. A filter is a device that boosts certain frequencies and attenuates others. In particular, a band-pass filter allows a range of frequencies within the bandwidth to pass through while stopping those outside the cut-off frequencies. The term "critical band" is discussed in Moore, B. C. J., "An introduction to the Psychology of Hearing" which is being incorporated herein by reference.

The Formant Segmentation Module 156 segments the speech spectral estimate into foments (e.g., vocal tract resonances). In some embodiments, a formant is defined as a spectral range between two local minima (valleys), and thus this module detects all spectral valleys in the speech spectral estimate. The center frequency of each formant is also computed by this module as the maximum spectral magnitude in the formant spectral range (i.e., between its two surrounding valleys). This module then normalizes the speech spectrum based on the detected formant segments.

The Formant Boost Estimator 152 yields a set of gain factors to apply to each frequency component of the input speech so that the resulting SNR within each formant (as discussed above) reaches a certain or pre-selected target. These gain factors are obtained by multiplying each formant segment by a certain or pre-selected factor ensuring that the target SNR within the segment is reached.

The Output Limiting Mixer 118 finds a time-varying mixing factor applied to the difference between the input and output signals so that the maximum allowed dynamic range or root mean square (RMS) level is not exceeded when mixed with the input signal. This way, when the maximum dynamic range or RMS level is already reached by the input signal, the mixing factor equals zeros and the output equals the input. On the other hand, when the output signal does not exceed the maximum dynamic range or RMS level, the mixing factor equals 1, and the output signal is not attenuated.

Boosting independently each spectral component of speech to target a specific spectral signal-to-noise ratio (SNR) leads to shaping speech according to noise. As long as the frequency resolution is low (i.e., it spans more than a single speech spectral peak), treating equally peaks and valleys to target a given output SNR yields acceptable results. With finer resolutions however, output speech might be highly distorted. Noise may fluctuate quickly and its estimate may not be perfect. Besides, noise and speech might not come from the same spatial location. As a result, a listener may cognitively separate speech from noise. Even in the presence of noise, speech distortions may be perceived because the distortions are not completely masked by noise.

One example of such distortions is when noise is present right in a spectral speech valley: straight adjustment of the level of the frequency components corresponding to this valley to increase their SNR would perceptually dim its surrounding peaks (i.e., spectral contrast has then been decreased). A more reasonable technique would be to boost the two surrounding peaks because of the presence of noise in their vicinity.

A formant boost is typically obtained by increasing the resonances matching formants using an appropriate representation. Resonances can be obtained in a parametric form out of the LPC coefficients. However, it implies the use of polynomial root-finding algorithms, which are computationally expensive. A workaround would be to manipulate these resonances through the line spectral pair representation (LSP). Strengthening resonances consists of moving the poles of the autoregressive transfer function closer to the unit circle. Still this solution suffers from an interaction problem, where resonances which are close to each other are difficult to manipulate separately because they interact. The solution thus requires an iterative method which can be computationally expensive. Still, strengthening resonances narrows their bandwidth, which results in an artificially-sounding speech.

Figure 3:
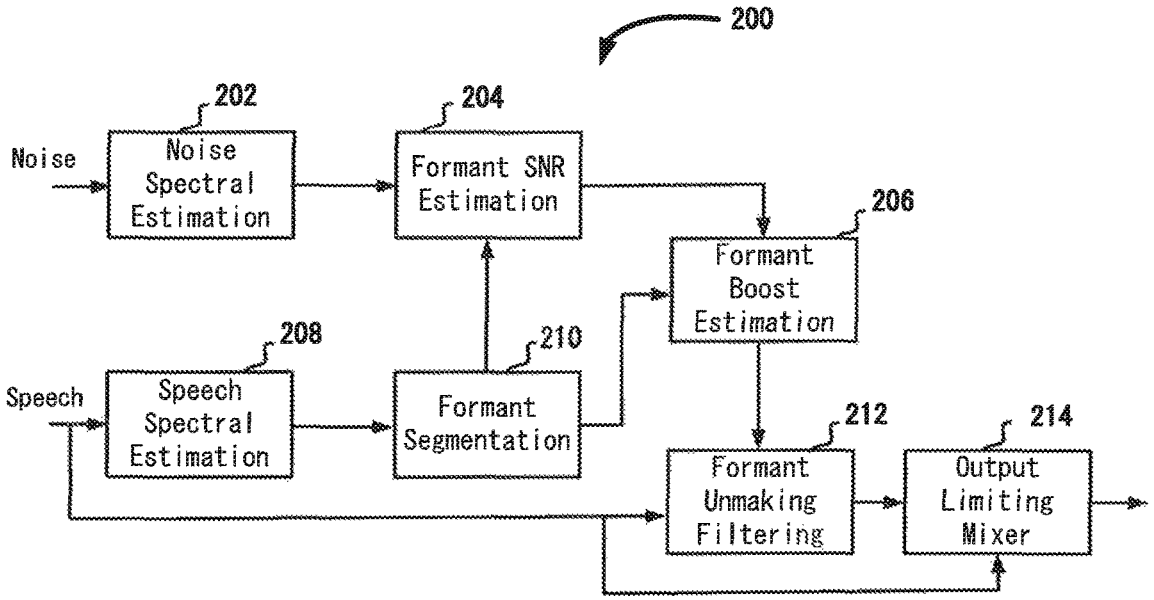
FIG. 3 depicts interaction between modules of the device in accordance with one or more embodiments of the present disclosure.

FIG. 3 depicts interaction between modules of the device 100. A frame-based processing scheme is used for both noise and speech, in synchrony. First, at steps 202 and 208, Power Spectral Density (PSD) of the sampled environmental noise and speech input frames are computed. As explained above, one of the goals is to improve SNRs around spectral peaks only. In other words, the closer a frequency component is to the peak of a formant to unmask, the greater should be its contribution to unmasking this formant. As a consequence, the contribution of frequency components in a spectral valley should be minimal. At step 210, the process of formant segmentation is performed. It may be noted that the sampled environmental noise is environmental noise and not the noise present in the input speech.

The Formant Segmentation module 156 specifically segments the speech spectral estimate computed at step 208 into formants. At step 204, together with the noise spectral estimate computed at step 202, this segmentation is used to compute a set of SNR estimates, one in the region of each formant. Another outcome of this segmentation is a spectral boost pattern matching the formant structure of input speech.

Based on this boost pattern and on the SNR estimates, at step 206, the necessary boost to apply to each formant is computed using the Formant Boost Estimator 152. At step 212, a formant unmaking filter may be applied and optionally the output of step 212 is mixed, at step 214, with the input speech to limit the dynamic range and/or the RMS level of the output speech.

In one embodiment, a low-order LPC analysis, i.e., an autoregressive model may be employed for the spectral estimation of speech. Modelling of high-frequency formants can further be improved by applying a pre-emphasis on input speech prior to LPC analysis. The spectral estimate is then obtained as the inverse frequency response of the LPC coefficients. In the following, spectral estimates are assumed to be in log domain, which avoids power elevation operators.

Figure 4:
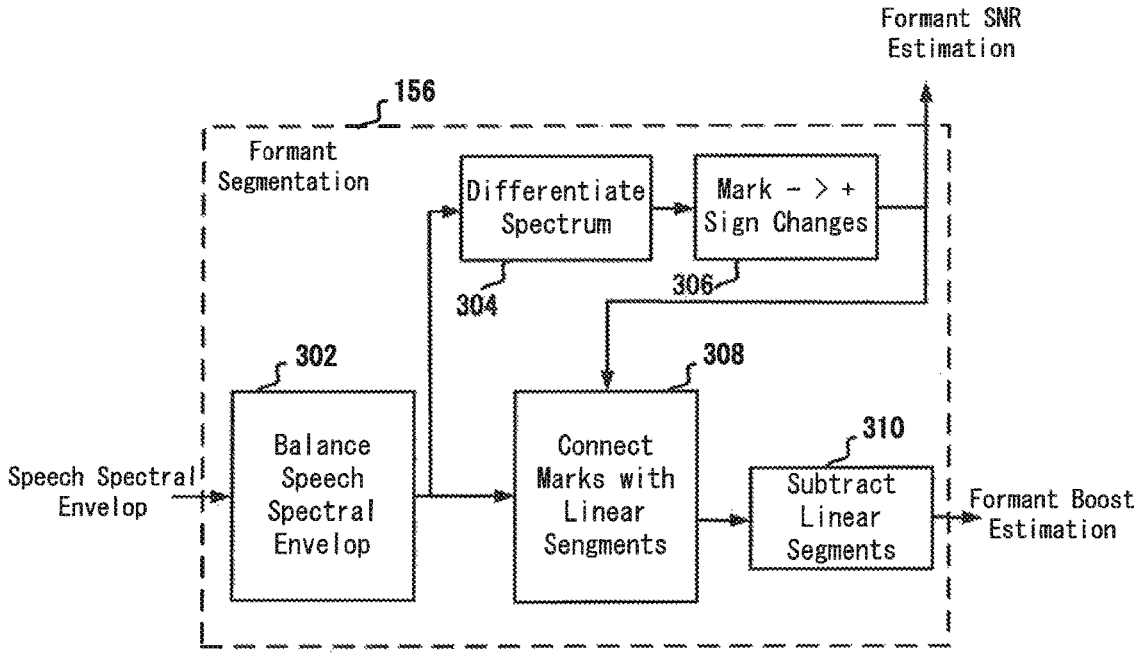
FIG. 4 illustrates operations of the formant segmentation module in accordance with one of more embodiments of the present disclosure.

FIG. 4 illustrates the operations of the formant segmentation module 156. One of the operations performed by the formant segmentation module 156 is to segment the speech spectrum into formants. In one embodiment, a formant is defined as a spectral segment between two local minima. The frequency indexes of these local minima then define the location of spectral valleys. Speech is naturally unbalanced, in the sense that spectral valleys are not reaching the same energy level. In particular, speech is usually tilted, with more energy towards low frequencies. Hence to improve the process of segmenting the speech spectrum into formants, the spectrum can optionally be "balanced" beforehand. In one embodiment, at step 302, this balancing is performed by computing a smoothed version of the spectrum using cepstrum low-frequency filtering and subtracting the smoothed spectrum from the original spectrum. At steps 304 and 306, local minima are detected by differentiating the balanced speech spectrum once, and then locating sign changes from negative to positive values. Differentiating a signal X of length n consists in calculating differences between adjacent elements of X: [X(2)−X(1) X(3)−X(2) . . . X(n)−X(n−1)]. The frequency components for which a sign change is located are marked. At step 308, a piecewise linear signal is created out of these marks. The values of the balanced speech spectral envelope are assigned to the marked frequency components, and values in between are linearly interpolated. At step 310, this piecewise linear signal is subtracted from the balanced speech spectral envelope to obtain a "normalized" spectral envelope, with all local minima equaling 0 dB. Typically, negative values are set to 0 dB. The output signal of step 310 constitutes a formant boost pattern which is passed on to the Formant Boost Estimator 152, while the segment marks are passed to the Formant SNR estimator 154.

Figure 5:
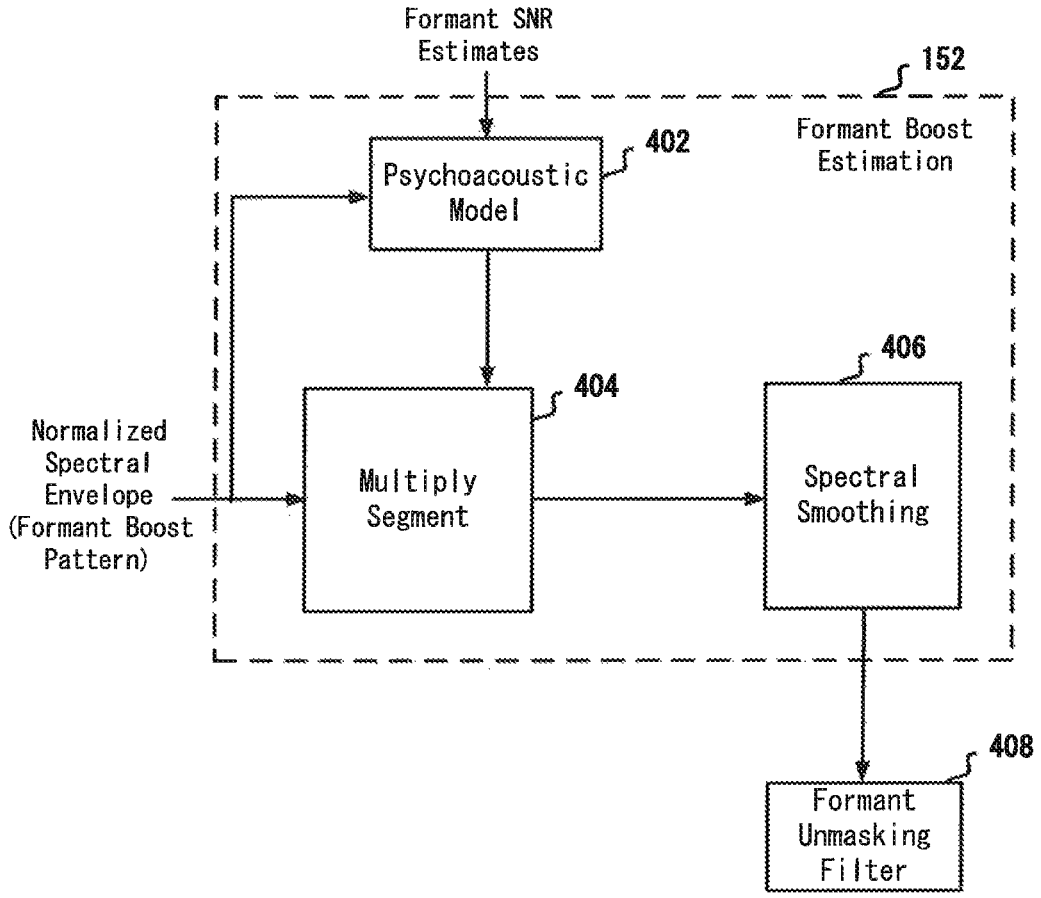
FIG. 5 illustrates operations of the formant boost estimation module in accordance with one of more embodiments of the present disclosure.

FIG. 5 illustrates operations of the formant boost estimator 152. The formant boost estimator 152 computes the amount of overall boost to apply to each formant, and then computes the necessary gain to apply to each frequency component to do so. At step 402, a psychoacoustic model is employed to determine target SNRs for each formant individually. The energy estimates needed by the psychoacoustic model are computed by the Formant SNR Estimator 154. The psychoacoustic model deduces a set of boost factors $\beta i \leq 0$ from the target SNRs. At step 404, these boost factors are subsequently applied by multiplying each sample of segment i of the boost pattern by associated factor $\beta i$. A very basic psychoacoustic model would ensure for instance that after applying boost factors, the SNR associated to each formant reaches a certain target SNR. More advanced psychoacoustic models can involve models of auditory masking and speech perception. The outcome of step 404 is a first gain spectrum, which, at step 406, is smoothed out to form the Formant Unmasking filter 408. Input speech is then processed through the formant unmasking filter 408.

In one example, to illustrate a psychoacoustic model ensuring that the SNR associated to each formant reaches a certain target SNR, boost factors may be computed as follows. This example considers only a single formant out of all the formants detected in the current frame. The same process may be repeated for other formants. The input SNR within the selected formant can be expressed as:

$$\xi_{in} = \frac{\Sigma_k S[k]^2}{\Sigma_k D[k]^2}$$

where S and D are the magnitude spectra (expressed in linear units) of the input speech and noise signals, respectively, and indexes k belong to the critical band centered on the formant center frequency. A[k] is the boost pattern of the current frame, and $\beta$ the sought boost factor of the considered formant. The gain spectrum would then be $A[k]^{\beta}$ when expressed in linear units. After application of this gain spectrum, the output SNR associated to this formant becomes:

$$\xi_{out} = \frac{\Sigma_k (S[k]A[k]^{\beta})^2}{\Sigma_k D[k]^2}$$

In one embodiment, one simple way to find $\beta$ is by iteration, starting from 0, increasing its value with a fixed step and computing $\xi_{out}$ at each iteration until the target output SNR is reached.

Balancing the speech spectrum brings the energy level of all spectral valleys closer to a same value. Then subtracting the piecewise linear signal ensures that all local minima, i.e., the "center" of each spectral valley equal 0 dB. These 0 dB connection points provide the necessary consistency between segments of the boost pattern: applying a set of unequal boost factors on the boost pattern still yields a gain spectrum with smooth transitions between consecutive segments. The resulting gain spectrum observes the desired characteristics previously stated: because local minima in the normalized spectrum equal 0 dB, solely frequency components corresponding to spectral peaks are boosted by the multiplication operation, and the greater the spectral value the greater the resulting spectral gain. As is, the gain spectrum ensures unmasking of each of the formants (in the limits of the psychoacoustic model), but the necessary boost for a given formant could be very high. Consequently, the gain spectrum can be very sharp and create unnaturalness in the output speech. The subsequent smoothing operation slightly spreads out the gain into the valleys to obtain a more natural output.

In some applications, the output dynamic range and/or root mean square (RMS) level may be restricted as for example in mobile communication applications. To address this issue, the output limiting mixer 118 provides a mechanism to limit the output dynamic range and/or RMS level. In some embodiments, the RMS level restriction provided by the output limiting mixer 118 is not based on signal attenuation.

The use of the terms "a" and "an" and "the" and similar referents in the context of describing the subject matter (particularly in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. Furthermore, the foregoing description is for the purpose of illustration only, and not for the purpose of limitation, as the scope of protection sought is defined by the claims as set forth hereinafter together with any equivalents thereof entitled to. The use of any and all examples, or exemplary language (e.g., "such as") provided herein, is intended merely to better illustrate the subject matter and does not pose a limitation on the scope of the subject matter unless otherwise claimed. The use of the term "based on" and other like phrases indicating a condition for bringing about a result, both in the claims and in the written description, is not intended to foreclose any other conditions that bring about that result. No language in the specification should be construed as indicating any non-claimed element as essential to the practice of the invention as claimed.

Preferred embodiments are described herein, including the best mode known to the inventor for carrying out the claimed subject matter. Of course, variations of those preferred embodiments will become apparent to those of ordinary skill in the art upon reading the foregoing description. The inventor expects skilled artisans to employ such variations as appropriate, and the inventor intends for the claimed subject matter to be practiced otherwise than as specifically described herein. Accordingly, this claimed subject matter includes all modifications and equivalents of the subject matter recited in the claims appended hereto as permitted by applicable law. Moreover, any combination of the above-described elements in all possible variations thereof is encompassed unless otherwise indicated herein or otherwise clearly contradicted by context.

The invention claimed is:

1. A device, comprising:

a processor;

a memory, wherein the memory includes:

a noise spectral estimator to calculate noise spectral estimates from a sampled environmental noise;

a speech spectral estimator to calculate speech spectral estimates from a input speech signal, wherein the sampled environmental noise is not noise present in the input speech signal;

a formant segmentation module configured to detect local minima in the speech spectral estimates and to define a formant as a spectral segment between two local minima, wherein the formant segmentation module is further configured to detect local minima in the speech spectral estimates by balancing the speech spectral estimates, differentiating the balanced speech spectral estimates, locating sign changes from negative to positive values in the values of the differentiated balanced speech spectral estimates, and marking the locations of the sign changes as local minima, wherein balancing the speech spectral estimates comprises computing a smoothed version of the speech spectral estimates and subtracting the smoothed version of the speech spectral estimates from the speech spectral estimates;

a formant signal to noise ratio (SNR) estimator to calculate a set of formant-specific SNR estimates using the noise spectral estimates and speech spectral estimates within each formant detected in the input speech signal, wherein the formant SNR estimator is configured to calculate each formant-specific SNR estimate in the set of formant-specific SNR estimates using a ratio of speech and noise sums of squared spectral magnitude estimates over a critical band centered on a formant center frequency, wherein the critical band is a frequency bandwidth of an auditory filter; and a formant boost estimator to calculate a set of formant-specific gain factors from the set of formant-specific SNR estimates and to independently apply the set of formant-specific gain factors to each formant detected in the input speech signal such that the resulting SNR within each formant reaches a pre-selected formant-specific target SNR value.

2. The device of claim 1, wherein the noise spectral estimator is configured to calculate noise spectral estimates through averaging, using a smoothing parameter and past spectral magnitude values obtained through a Discrete Fourier Transform of the sampled noise.

3. The device of claim 1, wherein the speech spectral estimator is configured to calculate the speech spectral estimates using a low order linear prediction filter.

4. The device of claim 3, wherein the low order linear prediction filter uses a Levinson-Durbin Algorithm.

5. The device of claim 1, wherein the formant-specific gain factors are calculated by multiplying each formant in the input speech signal by a pre-selected factor.

6. The device of claim 5, wherein the each formant in the speech input signal is detected by a formant segmentation module, wherein the formant segmentation module segments the speech spectral estimates into formants.

7. The device of claim 1, further including an output limiting mixer, wherein the formant boost estimator produces a filter to filter the input speech signal and an output of the filter combined with the input speech signal is passed through the output limiting mixer.

8. The device of claim 7, further including a formant unmasking filter to filter the input speech signal and to input an output of the formant unmasking filter to the output limiting mixer.

9. The device of claim 1, wherein the formant segmentation module is further configured to create a piecewise linear signal from the marked locations and to subtract the piecewise linear signal from a corresponding balanced speech spectral envelope to obtain a normalized spectral envelope in which all local minima equal 0 dB.

10. The device of claim 1, wherein the smoothed version of the speech spectral estimates is computed using cepstrum low-frequency filtering.

11. A method for performing an operation of improving speech intelligibility, comprising:

receiving an input speech signal;

calculating noise spectral estimates from a sampled environmental noise, wherein the sampled environmental noise is not noise present in the input speech signal;

calculating speech spectral estimates from the input speech signal;

segmenting formants in the speech spectral estimates by detecting local minima in the speech spectral estimates, wherein a formant is defined as a spectral segment between two local minima, wherein segmenting formants in the speech spectral estimates comprises detecting local minima in the speech spectral estimates by balancing the speech spectral estimates, differentiating the balanced speech spectral estimates, locating sign changes from negative to positive values in the values of the differentiated balanced speech spectral estimates, and marking the locations of the sign changes as local minima, wherein balancing the speech spectral estimates comprises computing a smoothed version of the speech spectral estimates and subtracting the smoothed version of the speech spectral estimates from the speech spectral estimates;

calculating a set of formant-specific signal to noise ratio (SNR) estimates using the calculated noise spectral estimates and the speech spectral estimates, wherein each formant-specific SNR estimate in the set of formant-specific SNR estimates is calculated using a ratio of speech and noise sums of squared spectral magnitude estimates over a critical band centered on a formant center frequency, wherein the critical band is a frequency bandwidth of an auditory filter;

calculating formant-specific gain factors for each of the formants based on the calculated set of formant-specific SNR estimates such that the resulting SNR within each formant reaches a pre-selected formant-specific target SNR value; and applying the formant-specific gain factors individually to each formant.

12. The method of claim 11, wherein the noise spectral estimates are calculated through a process of averaging, using a smoothing parameter and past spectral magnitude values obtained through a Discrete Fourier Transform of the sampled environmental noise.

13. The method of claim 11, wherein the calculating the noise spectral estimates includes calculating the speech spectral estimates using a low order linear prediction filter.

14. The method of claim 13, wherein the low order linear prediction filter uses a Levinson-Durbin Algorithm.

15. The method of claim 11, wherein the formant-specific gain factors are calculated by multiplying each formant in the input speech signal by a pre-selected factor.

16. A non-transitory computer-readable medium that stores computer readable instructions which, when executed by a processor, cause said processor to carry out or control the method of claim 11.

17. The method of claim 11, wherein segmenting formants in the speech spectral estimates comprises creating a piecewise linear signal from the marked locations and subtracting the piecewise linear signal from a corresponding balanced speech spectral envelope to obtain a normalized spectral envelope in which all local minima equal 0 dB.

18. The method of claim 11, wherein the smoothed version of the speech spectral estimates is computed using cepstrum low-frequency filtering.

* * * * *